US010275979B2

(12) United States Patent
Gawel

(10) Patent No.: US 10,275,979 B2
(45) Date of Patent: Apr. 30, 2019

(54) TERMINAL SYSTEM

(71) Applicant: NOVOMATIC AG, Gumpoldskirchen (AT)

(72) Inventor: Marek Gawel, Gumpoldskirchen (AT)

(73) Assignee: NOVOMATIC AG, Gumpoldskirchen (AT)

( * ) Notice: Subject to any disclaimer, the term of this patent is extended or adjusted under 35 U.S.C. 154(b) by 26 days.

(21) Appl. No.: 15/546,529

(22) PCT Filed: Jan. 29, 2016

(86) PCT No.: PCT/EP2016/051968
§ 371 (c)(1),
(2) Date: Jul. 26, 2017

(87) PCT Pub. No.: WO2016/120464
PCT Pub. Date: Aug. 4, 2016

(65) Prior Publication Data

US 2018/0276943 A1 Sep. 27, 2018

(30) Foreign Application Priority Data

Jan. 30, 2015 (AT) ..... A 50078/2015
Jan. 30, 2015 (DE) ..... 20 2015 000 755 U

(51) Int. Cl.
*A47C 31/00* (2006.01)
*G07F 17/32* (2006.01)
(Continued)

(52) U.S. Cl.
CPC ..... *G07F 17/3216* (2013.01); *A47C 7/72* (2013.01); *A47C 15/004* (2013.01); *A47C 7/002* (2013.01)

(58) Field of Classification Search
CPC ..... A63F 13/25; A63F 13/08; A63F 13/90; A63F 2300/1043; G07F 17/3211;
(Continued)

(56) References Cited

U.S. PATENT DOCUMENTS 5,791,731 A 8/1998 Infanti
6,354,660 B1 3/2002 Friedrich
(Continued)

FOREIGN PATENT DOCUMENTS

EP 0530453 B1 8/2000

OTHER PUBLICATIONS

International Search Report dated Apr. 7, 2016 for International Application No. PCT/EP2016/051968 filed Jan. 29, 2016.

*Primary Examiner* — Justin L Myhr
(74) *Attorney, Agent, or Firm* — Avery N. Goldstein; Blue Filament Law PLLC

(57) ABSTRACT

A terminal system including a device terminal (2) and an operator seat (3) which can be connected together and both having energy and/or signal coupling parts (5) and mechanical positioning coupling parts (6) that are coupled to each other by pushing together the seat (3) and terminal (2), the positioning coupling parts (6) including separately formed vertical and horizontal positioning means for orienting the seat (3) with respect to the terminal (2), the vertical positioning means (7) having a clearance in the horizontal direction transversely to the coupling and decoupling direction (24) and the horizontal positioning means (8) having a clearance (13) in the vertical direction, the vertical positioning means (7) and/or the horizontal positioning means (8) each having at least two pairs of coupling pieces (9, 10) transversely spaced apart with respect to a longitudinal center plane through the seat (3) and/or the terminal (2).

11 Claims, 8 Drawing Sheets

(51) Int. Cl.

| | |
|---|---|
| ***A47C 7/72*** | (2006.01) |
| ***A47C 15/00*** | (2006.01) |
| *A47C 7/00* | (2006.01) |

(58) Field of Classification Search
CPC ..... G07F 17/3216; G07F 17/3204; A47C 15/004; A47C 9/022; A47C 7/002; A47C 9/00
See application file for complete search history.

(56) References Cited

U.S. PATENT DOCUMENTS

| | | | |
|---|---|---|---|
| 2008/0136228 | A1 | 6/2008 | Friedrich |
| 2008/0211276 | A1 | 9/2008 | Rasmussen |
| 2009/0146484 | A1 | 6/2009 | Mittler et al. |
| 2011/0261509 | A1 | 10/2011 | Xu |
| 2012/0282997 | A1 | 11/2012 | Miner et al. |

TERMINAL SYSTEM

CROSS-REFERENCE TO RELATED APPLICATIONS

This application claims priority benefit of PCT Application No. PCT/EP2016/051968, filed on Jan. 29, 2016, the contents of which are hereby incorporated by reference in its entirety

TECHNICAL FIELD

The present invention generally pertains to a terminal system including a device terminal as well as an operator's seat which can be connected to the device terminal. The invention also individually relates to the device terminal and the operator's seat for such a terminal system. The invention particularly pertains to a terminal system in which the device terminal and the operator's seat, which can be connected to it, feature connectable electrical and/or signal coupling parts as well as separate, mechanical positioning coupling parts, whereby the electrical and/or signal coupling parts and the positioning coupling parts can each be engaged with one another through pushing operator's seat and device terminal together parallel to the ground, wherein said positioning coupling parts feature vertical and horizontal positioning aids for the vertical and horizontal alignment of the device terminal and the operator's seat relative to one another.

BACKGROUND

Coupling of electrical plug connectors without damaging them, particularly on relatively large items, tends to be difficult given that such electrical plug connectors are usually relatively sensitive. Furthermore, facilitating such coupling, namely moving and aligning items such that the electrical plug connectors may be coupled without damage can be difficult and labor-intensive, often resulting in damage to the electrical and/or signal coupling parts.

To be able to couple such electrical plug connectors without damaging them and to facilitate the plug-in, separate, mechanical positioning coupling parts can be installed on operator's seat and device terminal in addition to the electrical and/or signal coupling parts, which align operator's seat and device terminal relative to one another when pushing together or hold operator's seat and device terminal together in the coupled or connected position, to prevent lateral movements diagonally to the direction of coupling, which could damage the electrical and/or signal coupling parts To facilitate coupling, mechanical positioning coupling parts can be installed on operator's seat and device terminal in addition to the electrical and/or signal coupling parts, which align operator's seat and device terminal relative to one another when pushing together or hold operator's seat and device terminal together in the coupled or connected position, to prevent lateral movements diagonally to the direction of coupling, which could damage the electrical and/or signal coupling parts. Such positioning coupling parts can be, for example complementary contours which slide into one another such as for instance pins and plug holes.

The US 2012/0282997 A1 document, for instance, shows such a terminal system of the generic type, wherein said electrical and/or signal coupling parts and the mechanical positioning coupling parts are provided on a foot section of the device terminal as well as a floor base area of the operator's seat, so that the floor base area of the operator's seat can be plugged into the foot of the device terminal, whereby the inserted position can be secured by a latch-like snap lever. In this case, the mechanical positioning coupling parts, on the one hand, include slanted tongues, bent diagonally to the insertion direction, which can be plugged into complementary plug-in recesses and provide a rough pre-centering in vertical and horizontal direction. On the other hand, conical plug pins are provided which can be plugged into complementary plug-in holes in order to enable a fine alignment in the horizontal and vertical direction.

However, threading the positioning coupling parts into one another is relatively tedious in this known terminal system since the respective insertion openings are difficult to find. Moreover, the stability in clamped position is limited, so that a shaking of the operator's seat can lead to a breaking of the connection via the slants of the tongues and plug pins. Furthermore, the design of the slanted and diagonally bent tongues is relatively complicated in terms of production technology.

Therefore, there exists a need for an improved terminal system and/or an improved device terminal and/or an improved operator's seat of the type mentioned in each case, which avoids disadvantages of the state of technology and advantageously develops the latter. In particular, the mechanical positioning coupling between the operator's seat and the device terminal is to be improved, whereby a simplified handling when connecting the operator's seat with the device terminal and a high stability in the assembled state is to be preferably achieved.

SUMMARY

The device terminal of such a terminal system can be, for example, a game and/or entertainment and/or betting machine or a multimedia terminal or also a different, preferably electronic terminal or device for which an operator is usually positioned in front of the device. The device terminal can, for instance, include one or several screens, which can be arranged above and/or next to one another and if necessary feature input devices, for example in the form of a control panel, to be able to provide different input signals. These can for instance be start and/or play buttons, control levers such as joysticks or other input devices such as touchscreens.

The operator's seat of such a terminal system can in particular be a chair or seat with a backrest or also a back-free stool, each with or without armrests, whereby it may be a single seat or stool or also furniture with several seats in the sense of a sofa, a chaise lounge or a canapé. However, the operator's seat may also only feature a leaning or lounging area, for instance in the sense of a padded leaning or settling area or rod and can generally be broadly defined.

Different control elements may be present on the operator's seat that can be activated, for example, by electrical or also pneumatic or hydraulic control actuators, for instance, in the form of inflatable sidewalls or lumbar supports, angle adjustable backrests, height control elements or even rocker or shaking actuators which can move the operator's seat in specific game situations, for example, an angling seat when a corner is taken in a driving game. To power such control actuators, it can be advantageous to be able to provide the operator's seat with power from the device terminal, for example in the form of electricity, compressed air or hydraulic fluid.

Furthermore, said operator's seat can also include control devices for entering positioning signals or other control signals, whereby for instance input buttons, control levers, such as joysticks, fingerprint sensors or card readers can be installed on a backrest or other section of the furniture. Alternatively, or additionally, display devices such as screens or signal lights, e.g. in the form of LEDs, can be installed on the operator's seat in order to be able to display information from the device terminal on the operator's seat.

Both the operator's seat and the device terminal can each have electrical and/or signal coupling parts to be able to transfer electricity and signals between device terminal and operator's seat, whereby transmission can take place from the device terminal to the operator's seat and/or from the operator's seat to the device terminal. These can be coupled through pushing together the operator's seat and the device terminal, so that the electrical and signal coupling is also closed by simply pushing together in the proper position. Said electrical and/or signal coupling parts can in particular be designed as plug-in coupling parts, for instance in the sense of male and female connectors whose coupling direction for coupling and uncoupling can advantageously run to the device terminal parallel to the ground, diagonally to the visual axis, so that they can be coupled by merely pushing the operator's seat and the device terminal together and uncoupled by pulling apart.

According to the invention, this object is achieved with a terminal system according to claim 1, a device terminal according to claim 11 as well as an operator's seat according to claim 12. Preferred modifications of the invention are subject matter of the dependent claims.

It is therefore proposed to separate the vertical and horizontal positioning of the connection section of the operator's seat with the connection section of the device terminal from one another and to no longer use the same plug-in coupling pair. According to the invention, the vertical positioning aids of the positioning coupling and the horizontal positioning aids of the positioning coupling are separate coupling parts, whereby the vertical positioning aids have a clearance in horizontal direction and the horizontal positioning aids have a clearance in vertical direction. Thus, the vertical positioning aids can only be designed vertically positioning and the horizontal positioning aids only horizontally positioning. Said clearance in horizontal direction does not refer to the plug-in or coupling direction in which the positioning coupling parts and the electrical and/or signal coupling parts can be coupled and uncoupled, but refers to a horizontal clearance, diagonal to said coupling and uncoupling direction. Horizontal and vertical, both in relation to the clearance as well as to the effectiveness of the positioning aids, does not necessarily refer to an exactly horizontal or exactly vertical direction in the mathematical sense, but is to be understood in the sense of upright and laying down and can thus be essentially horizontal and vertical directions with acute deviations thereof.

In this case, the operator's seat can be locked with the device terminal after coupling, whereby said clearances are no longer present or sealed in locked state.

The separately designed coupling parts or pairs of coupling parts, that form the aforementioned vertical positioning aids and horizontal positioning aids, can, in particular, be arranged at a distance from each other. The aforementioned separation of the horizontal and vertical positioning aids can facilitate the coupling process and avoid a difficult threading. Since the vertical positioning aids, which align the device terminal in the upright direction relative to the operator's seat, have free movement in the horizontal direction diagonally to the coupling and uncoupling direction and have clearance, finding the horizontal positioning aids or the coupling of the coupling parts of the horizontal positioning aids is not impeded as the vertical positioning aids float in said horizontal direction, meaning they can be moved. Conversely, the horizontal positioning aids do not impede finding the coupling parts of the vertical positioning aids due to their free movement and clearance in upright position. Moreover, the separate, spaced apart configuration of the vertical positioning aids and the horizontal positioning aids makes it possible to achieve greater stability in the coupled position, since the vertical and horizontal positioning aids can be arranged and contoured without regard to one another and the respective transverse forces acting for example by jogging on the operator's seat are dispersed to different sections.

Advantageously, the vertical positioning aids and the horizontal positioning aids can be designed in such a way that they engage with each other in a time-delayed manner, i.e. first the vertical positioning aids and thereafter the horizontal positioning aids or vice versa, which can be achieved, for example, by different projection sizes or different covering lengths in the coupling direction.

In order to increase the stability of the coupled position, clamping devices for counter-tensioning the operator's seat and device terminal can be provided in a further development of the invention. In particular, clamping surfaces on the operator's seat and the device terminal, which overlap one another, can be pressed against each other by said clamping devices, so that not only a tilting of the clamping surfaces relative to one another and thus a tilting between the operator's seat and the device terminal, but also a shifting of said clamping surfaces through traction or friction is prevented or made more difficult, so that relative movements in the coupling and uncoupling direction as well as transversely thereto are avoided in a better manner.

Aforementioned clamping surfaces which cover each other and can be clamped against each other, can advantageously extend in a plane parallel to the coupling and uncoupling direction so that device terminal and operator's seat can be clamped against one another transversely to the coupling and uncoupling direction.

In particular, said clamping devices can have a vertical working direction and/or said clamping surfaces can be oriented at least approximately horizontally and/or can lie against a horizontally oriented plane, so that said clamping surfaces can be tensioned against each other in an upright direction.

Said clamping devices can for example form bolts by means of which the operator's seat can be screwed to the device terminal. Alternatively, or additionally, other clamping means can also be provided, for example, in the form of lug-shaped clamping levers, bayonet brackets or clamping jaws.

As an alternative or in addition to such clamping devices, however, positive safety and/or locking elements, for example in the form of securing bolts, may also be provided in order to secure the operator's seat and the device terminal in the connected position.

In a further development of the invention, said clamping devices and/or said safety or locking elements can be assigned to the mechanical positioning coupling parts, especially attaching directly to at least one of the positioning coupling parts. In particular, the clamping devices mentioned can be assigned to the vertical positioning aids and brace the coupling elements of said vertical positioning aids which can be brought into engagement with one another.

The coupling pieces forming said vertical positioning aids can advantageously comprise at least one pair of coupling edges that can be pushed on top of one another, which can, for instance, include a coupling tongue that protrudes in coupling and uncoupling direction, which can be pushed over an advantageously complementary coupling contour so that said coupling edges cover in vertical direction when looking at them. In particular, said coupling edges of the vertical positioning aids can be aligned horizontally, forming coupling flanges protruding in coupling and uncoupling direction, which can have horizontally aligned clamping surfaces and/or have horizontally inclined insertion chamfers to facilitate the engagement when pushing together operator's seat and device terminal.

In order to be able to better intercept the usually larger reaction forces in the area of the positioning coupling parts, which are caused by transverse tilting motions of the operator's seat, for example by right and left inclinations of the upper body of an operator, said vertical positioning aids, in a further development of the invention, can have several pairs of overlapping coupling pieces, which can be arranged transversely spaced apart from one central axis in the coupling and uncoupling direction, for example in a common horizontal plane in the area of right and left edge sections of the connection sections of the operator's seat and the device terminal which can be connected to one another. As a result, the vertical positioning aids obtain a relatively large level arm with respect to said transverse tilting movements. By means of an, at least approximately, flat, planar design of the aforementioned coupling tongues of the vertical positioning aids, excessive surface pressures can be avoided.

In a further development of the invention, the aforementioned horizontal positioning aids can include a coupling edge, for example in the form of a coupling pin, as well as a coupling recess into which said coupling edge can enter. For example, said coupling edge can form an upright pin which can enter into an elongated hole that may have an opening or open front side in coupling and uncoupling direction. The opposite end of said elongated hole can form a stop for said coupling edges or pins, which limits the mating of the electrical and/or signal coupling parts and/or the mating of the positioning coupling parts in coupling and uncoupling direction and can define the fully engaged coupling position. As an alternative or in addition, stops for limiting the coupling movement can also be provided separate from the horizontal positioning aids.

In a further development of the invention, said horizontal positioning aids can have a plurality of such pairs of coupling edges and recesses, which can also be arranged at a distance from one another in horizontal direction transverse to the central axis in the coupling and uncoupling direction.

Said electrical and/or signal coupling parts and/or said mechanical positioning coupling parts can advantageously be arranged on a front section of a floor support plate and/or a floor support frame of the operator's seat and an opposite front of a foot section of the device terminal.

BRIEF DESCRIPTION OF THE DRAWINGS

The invention will be further described in the following using a preferred embodiment and associated drawings. In the drawings.

DETAILED DESCRIPTION

Figure 1:
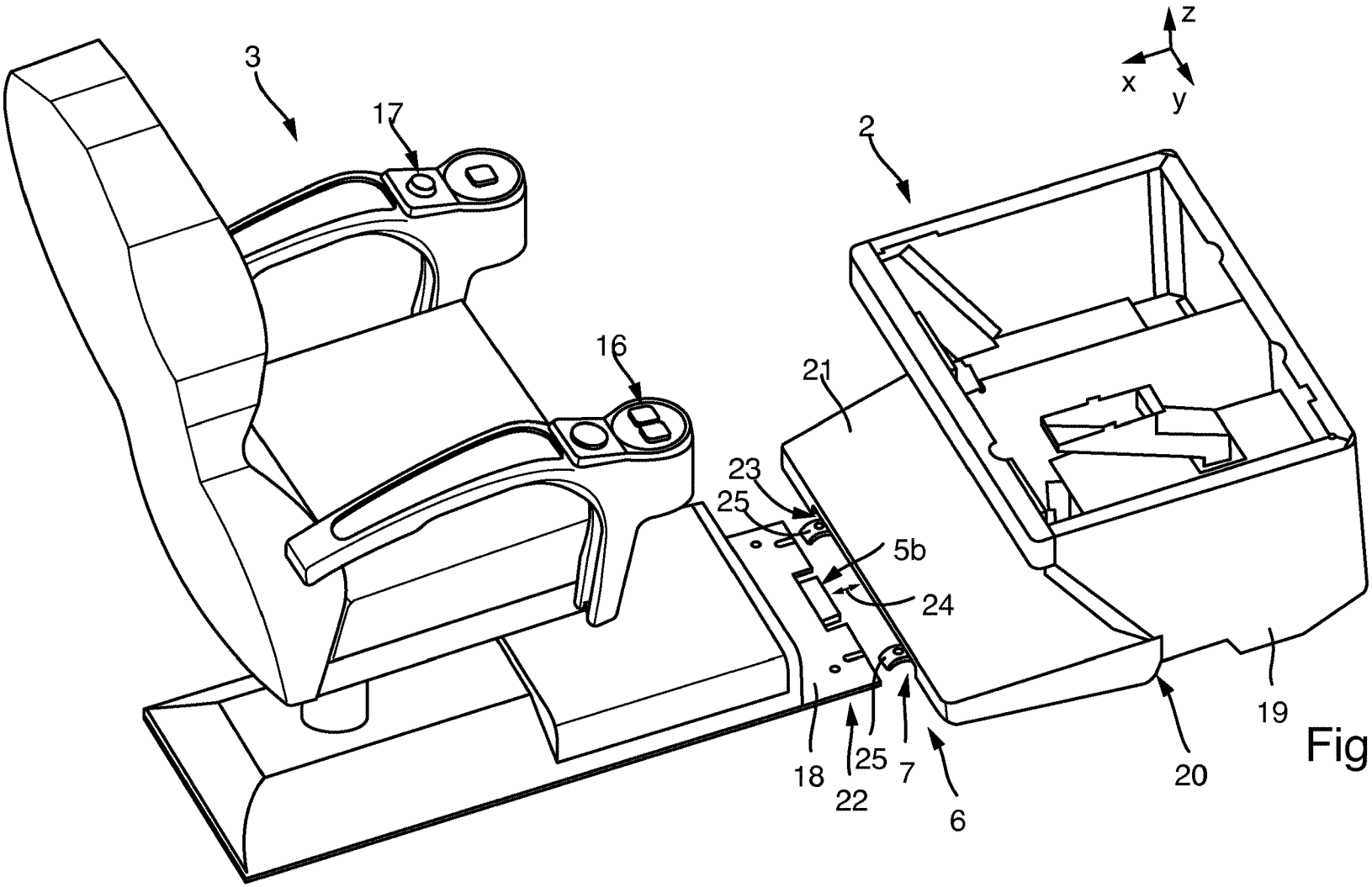
FIG. 1: A perspective side view of a terminal system comprising a device terminal shown only in section and an operator's seat in the form of a chair, which can be connected thereto, whereby the device terminal and the operators seat are shown in a mutually aligned but still separate position.

As FIG. 1 shows, the terminal system 1 can comprise a device terminal 2, to which an operator's seat 3, for example in the form of a chair, can be detachably connected, so that the operator's seat 3 and the device terminal 2 form a unit.

Said operator's seat 3 can, in a generally common manner, have armrests in addition to a seat and a backrest, on which input devices 16 can be provided for inputting control signals for the device terminal 2, and display devices 17 for the displaying information which can be provided in the device terminal 2. Said input devices 16 can include the input buttons shown in FIG. 1, such as a game start button but also other input devices as mentioned at the outset. The display devices 17 can include lights, for instance in the form of LEDs, but also small display units, touch sensors, touch screens and the like.

The operator's seat 3 can feature a floor support body 18 which can, for example, be basically designed as a level floor plate, as shown in FIG. 1. In this case, special support means, such as rollers, skids or pressure distribution ledges can be provided at the underside of the floor support body 18. The chair can be mounted on said floor support body rigidly or also movably, for instance rotatable on an upright axis or tiltable on a horizontal axis.

Furthermore, said operator's seat can have various adjustment possibilities, which can also be actuated by control actuators powered by external energy such as electric motors. Such adjustment possibilities can for instance include the tilting of the backrest, height adjustment of the seat surface, inflation of the side walls of the backrest or the extension and retraction of lumbar supports.

The device terminal 2 can include an upright housing corpus 19, on the foot area of which a floor support body 20 can also be provided, whereby this floor support body 20 can feature a footboard protruding towards the operator's seat 3 or a footrest 21 designed in another way such as grating or a footrest with support bars.

Said device terminal 2 can be designed in particular as a game and/or entertainment or gambling machine, or in the form of another multimedia device and can for instance include one or several displays which are omitted in FIG. 1 for the sake of clarity. Moreover, further display and/or input devices, for example in the form of operating buttons, touch screens, money input and output devices, card readers or similar, can be provided on the housing body 19, wherein, for instance, and operating panel can be arranged under said displays so that an operator sitting in the operator's seat 3 can interact with the input and output devices on the device terminal side.

As shown in FIG. 1, the operator's seat 3 and the device terminal 2 are designed detachably connectable to a rigid unit or can be connected in a fixed manner. In this case, the front sides of the floor support bodies 18 and 20 of the operator's seat 3 and the device terminal 2 facing each other can form connection sections 22 and 23 which are adapted to one another and at least partially complementary. The connection section 22, which is formed by the front side of the floor plate of operator's seat 3, can in particular be connected with connection section 23, which is formed by the opposing front section of the foot rest 21, by pushing the operator's seat 3 and the device terminal 2 over each other or together.

Figure 7:
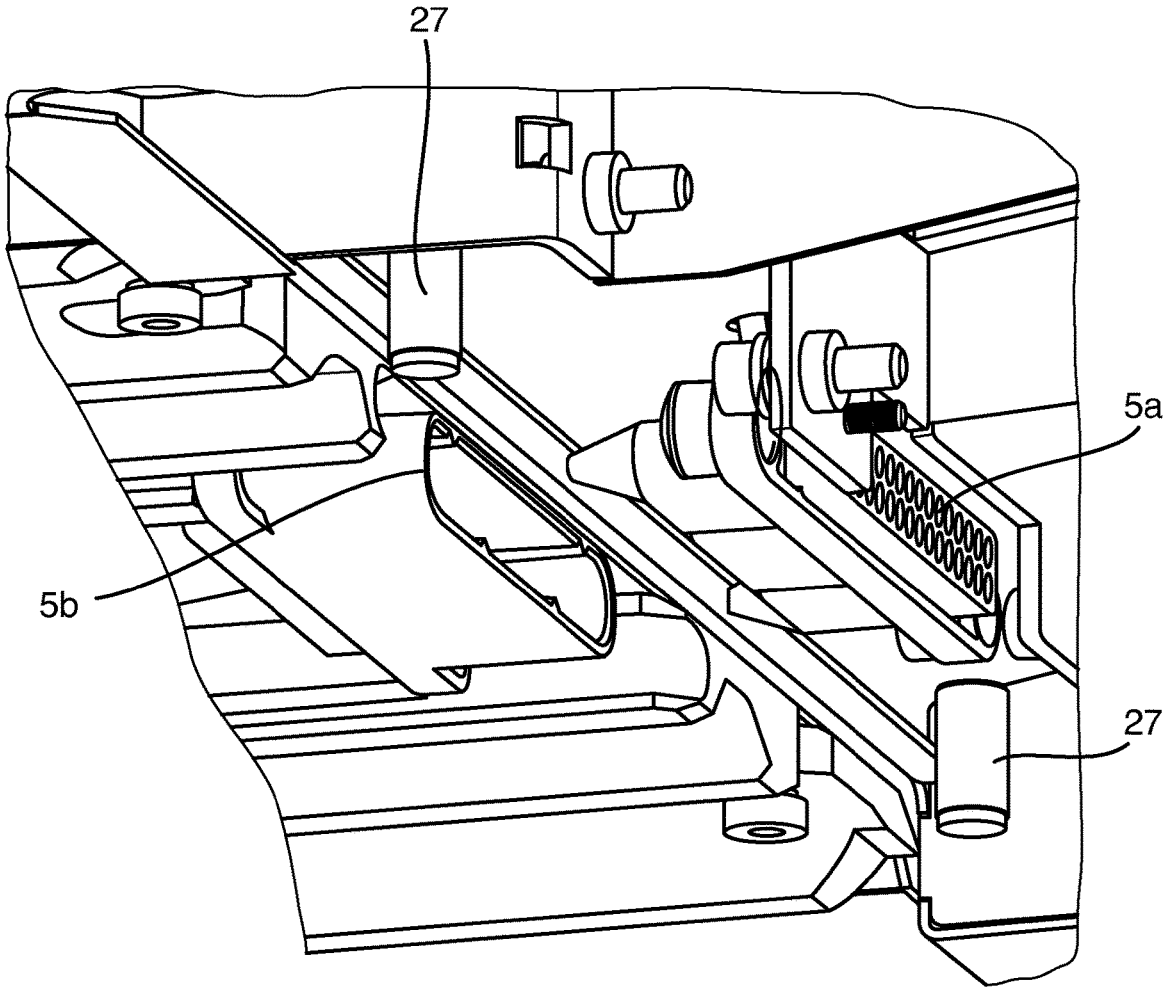
FIG. 7: A perspective view of the electrical and signal coupling parts in a position not yet engaged.
Figure 8:
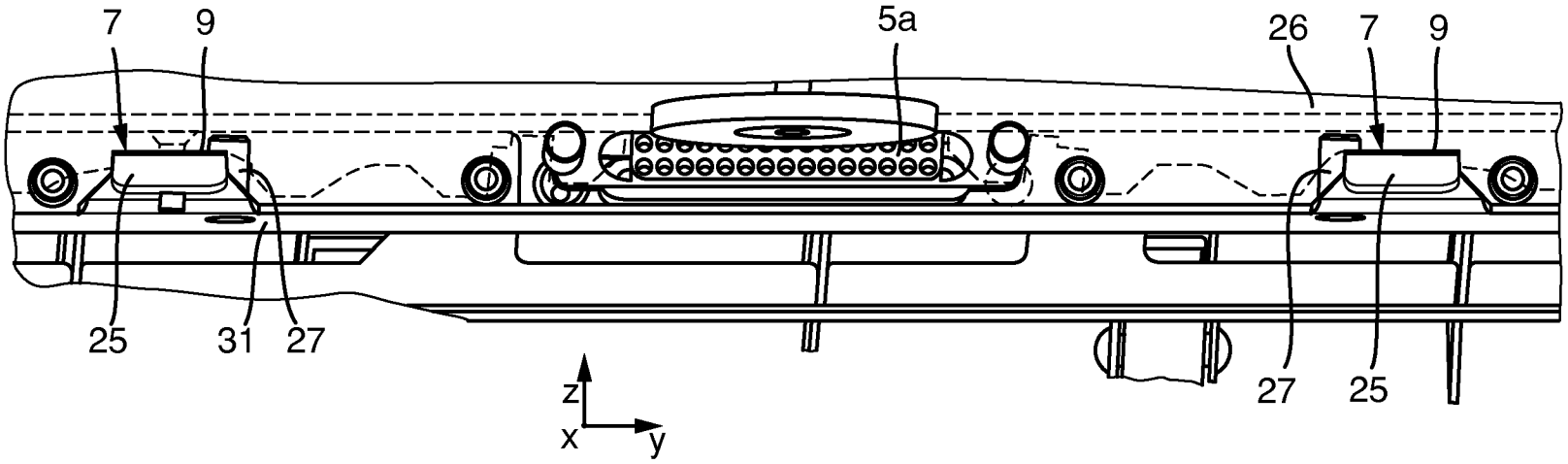
FIG. 8: A schematic representation of the electrical and/or signal coupling parts and positioning coupling parts on the device terminal side in a viewing angle approximately parallel to the coupling and uncoupling direction.

As shown in FIG. 7, electrical and signal coupling parts 5 can be provided on said connection sections 22 and 23, which, in the coupled state, can transfer energy, for instance in the form of an electric current for actuating aforementioned chair adjustment actuators, and data or signals from device terminal 2 to the operator's seat 3 and/or vice versa, for instance to transfer the control commands from the operator's seat 3 to the device terminal 2 and, vice versa, display signals from the device terminal 2 to the operator's seat 3.

Said electrical and signal coupling parts 5 can be designed as plug-in connections and aligned in such a way that the plug-in direction and thus the coupling and uncoupling direction 24 of aforementioned electrical and signal coupling parts 5 coincides with the direction of movement when pushing together operator's seat 3 and device terminal 2. In particular, the aforementioned coupling and uncoupling axis 24, see FIG. 1, can be aligned parallel to the floor or the floor support bodies or parallel to the undersides of said floor support bodies 18 and 20 and basically perpendicular to the front sides of the connection sections 22 and 23 or parallel to a fictive vertical longitudinal center plane through the operator's seat 3 and the device terminal 2.

As shown in FIG. 7, a device-terminal-side electrical and signal coupling part 5*a* can be mounted rigidly, or possibly also flexibly using a spring or hydraulic damper, on the device terminal 2 and a complementary electrical and signal coupling part 5*b* can be mounted rigidly, or possibly also flexibly on the operator's seat 3, whereby the two electrical and signal coupling parts 5*a* and 5*b* are arranged in such a way that they are freely accessible at least from one front side of the connection sections 22 and 23, i.e. freely accessible in the direction of said coupling and uncoupling axis 24 and engage with each other when pushed together. Furthermore, conical plug pins (see FIG. 7) are intended on the device-terminal-side electrical and signal coupling part 5*a*, which can be plugged into complementary plug-in holes in the electrical and signal coupling part 5*b* on the operator's seat 3 to achieve a fine alignment of the electrical and signal coupling part in horizontal and vertical direction.

In order to align the operator's seat 3 and the device terminal 2 with each other when pushing together and/or to attach them to one another in the connected state and/or hold them together, mechanical positioning coupling parts 6 are furthermore provided on the connection sections 22 and 23 of the operator's seat 3 and the device terminal 2, which can be rigidly connected to said connection sections 22 and 23 or also integrally designed on them. Said positioning coupling parts 6 are designed in such a way that they can be positively engaged with one another when pushing together device terminal 2 and operator's seat 3 along the aforementioned coupling and uncoupling axis 24 and disconnected from each other again when the device terminal 2 and the operator's seat 3 are pulled apart. The aforementioned positioning coupling parts 6 can, in this case, be plugged into one another or pushed onto one another, whereby the respective plug-in axis lies parallel to the aforementioned coupling and uncoupling axis 24, in particular parallel to the underside of the floor support bodies 18 and 20 and parallel to the vertical longitudinal center plane through the operator's seat 3 and the device terminal 2.

Said positioning coupling parts 6 include, on the one hand, vertical positioning aids 7, which align operator's seat 3 and device terminal 2 with each other in vertical direction, i.e. which in particular align said connection section 22 and 23 exactly to one another in their height level, especially so that the electrical and signal coupling parts 5 are at the same level when pushing together.

On the other hand, the positioning coupling parts 6 comprise the horizontal positioning aids 8, which align the operator's seat 3 and the device terminal 2 in horizontal direction, particularly diagonally to aforementioned coupling and uncoupling axis 24, more specifically in such a way that the electrical and signal coupling parts 5 have no clearance errors to the left or right when pushing together and/or that the connection sections 22 and 23 have no axial misalignments vertical to aforementioned vertical longitudinal plane.

As shown in FIGS. 1, 3, 4, 5 and 8, said vertical positioning aids 7 can comprise coupling parts 9 which can each be designed as a coupling edge which protrudes in the direction of the coupling and uncoupling axis 24. In particular, said coupling parts 9 can, on the one hand, have coupling flanges 25 protruding against the coupling and uncoupling axis 24, which can be designed in the form of level coupling flanges. On the other hand, a coupling part 9*b* engaging therewith can be formed from the underside of the front-side protruding connection section 22 and the floor support body 18 of the operator's seat 3, which slides the underside onto the upper side of said coupling flap 25 when the operator's seat 3 and the device terminal 2 are pushed together. For this purpose, said coupling flap 25 and/or the front-side edge of the underside of the floor support body 18 of the operator's seat 3 can have a run-up slope 30 inclined to the horizontal.

In the illustrated design, said coupling flaps 25 are intended on the device-terminal-side connection section 23 and the coupling part 9*b*, which engages with it and is formed by the underside of the floor support body, on the connection part 22 of the operator's seat 3. In principle, however, an inverted arrangement may also be provided, namely the coupling flaps 25 being attached to the operator's seat 3.

Figure 2:
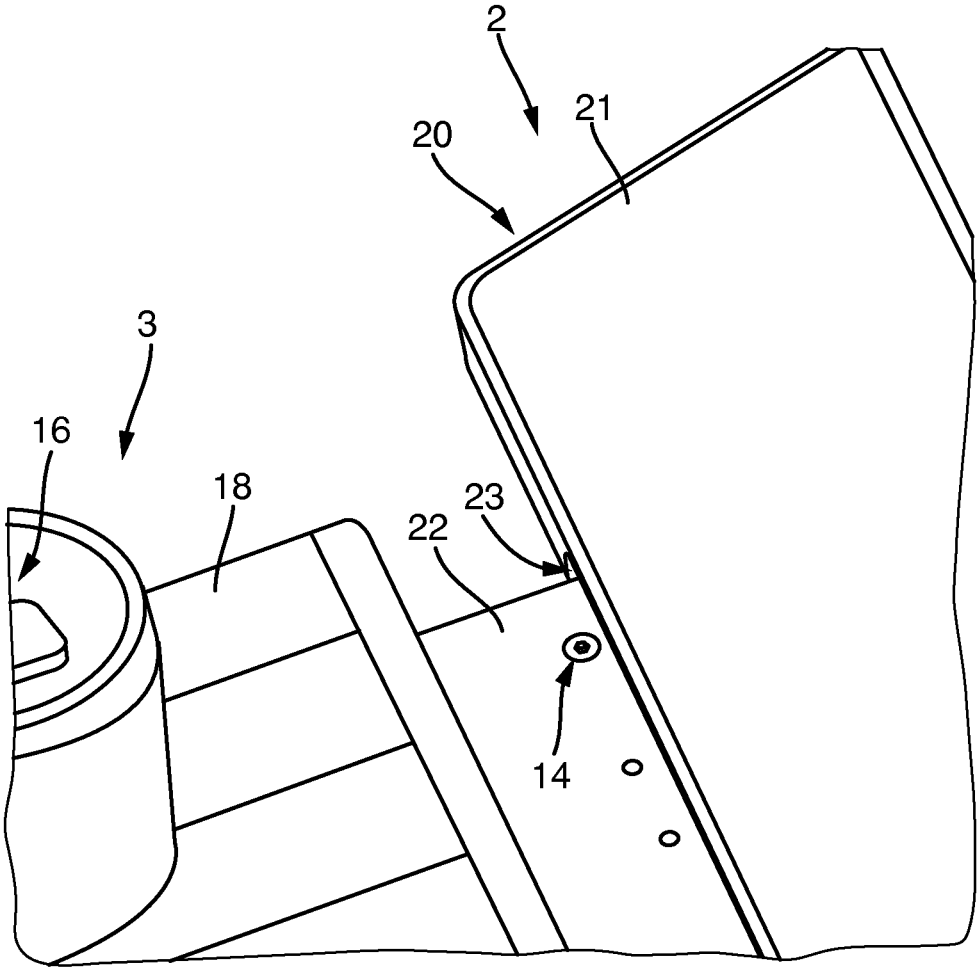
FIG. 2: A sectioned, enlarged view of the interface between operator's seat and device terminal in a connected, coupled position, with a clamping device in the form of a bolt is shown.
Figure 3:
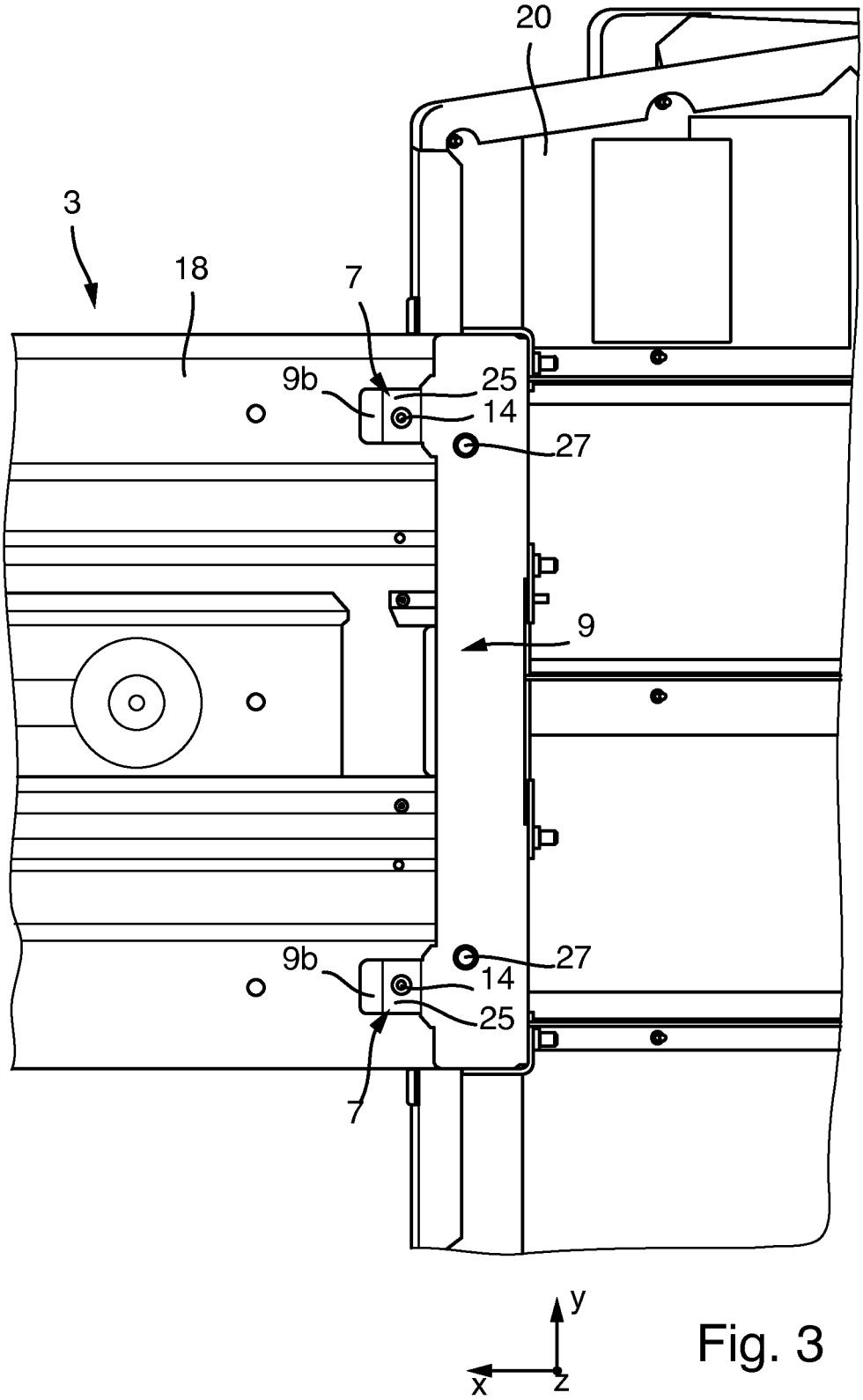
FIG. 3: A sectioned top view of the underside of the connection between operator's seat and device terminal, which shows the tongue-shaped coupling flap of the vertical positioning aids and the coupling edges on the operator's seat which have been pushed over it.
Figure 4:
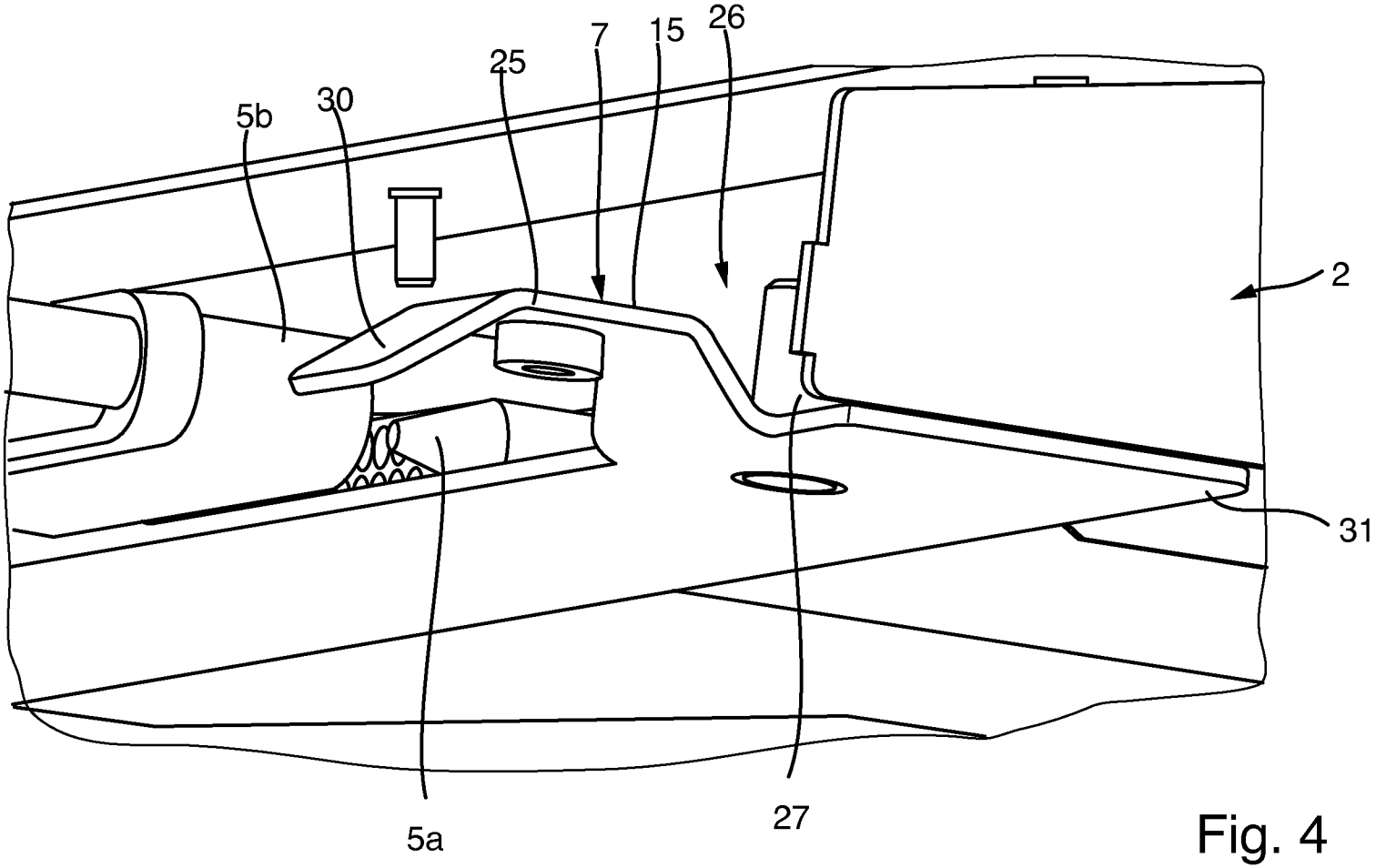
FIG. 4: A perspective, sectional view of the tongue-shaped coupling edges of the vertical positioning aids and the coupling pins of the horizontal positioning aids on the device terminal.
Figure 5:
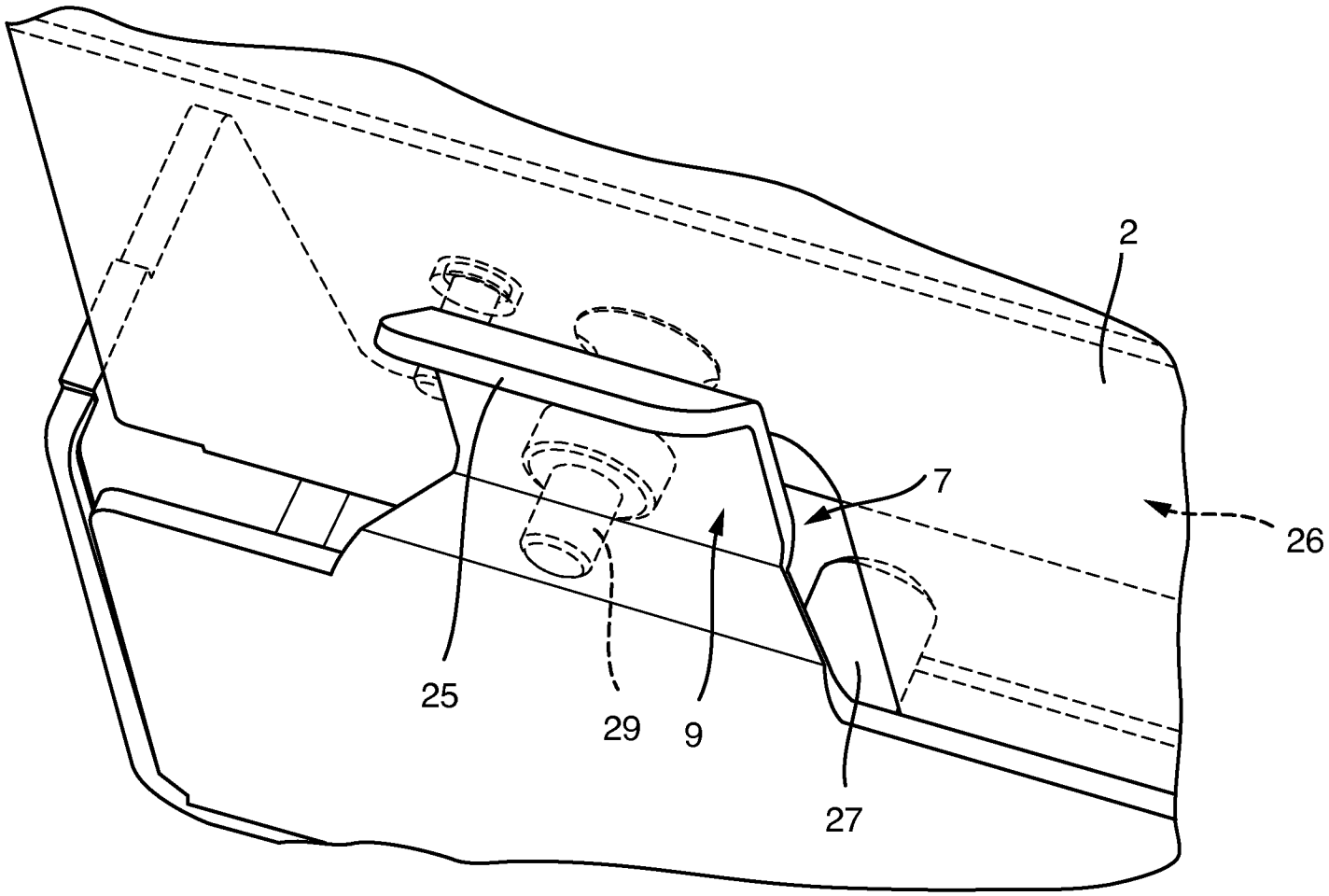
FIG. 5: A perspective view of the vertical positioning aids and the horizontal positioning aids on the device terminal from a different viewing angle as compared to FIG. 4, whereby the clamping devices are shown in the form of screw bolts for the vertical clamping of the tongue-shaped coupling flaps against the seat-side coupling edges which are not shown.

As FIG. 5 and also FIG. 4 clarify, the coupling flap 25 protrudes over the front side of the connection section 23 in the form of the ground support body 20. Advantageously, the connection section 23 can in this case comprise a receptacle open on the front side or an insertion recess 26 which extends over the coupling flap 25 into the depth of the connection section 23 and is limited by a ceiling on the top, so that the connection section 22 protruding on the front side can be pushed over the coupling flaps 25 into said pocket-shaped insertion compartment 26, see in comparison FIGS. 1 and 2 as well as FIG. 3.

As FIG. 1 and FIG. 3 show in particular, several, for instance two spaced-apart vertical positioning aids 7 can be provided in the form of said coupling flaps 25 and the complementary or mutually engaging coupling parts 9*b*, whereby at least two of said vertical positioning aids 7 can run symmetrically spaced from the vertical longitudinal plane, particularly in edge areas of the connection sections 22 and 23 of the operator's seat 3 and device terminal 2.

Figure 6:
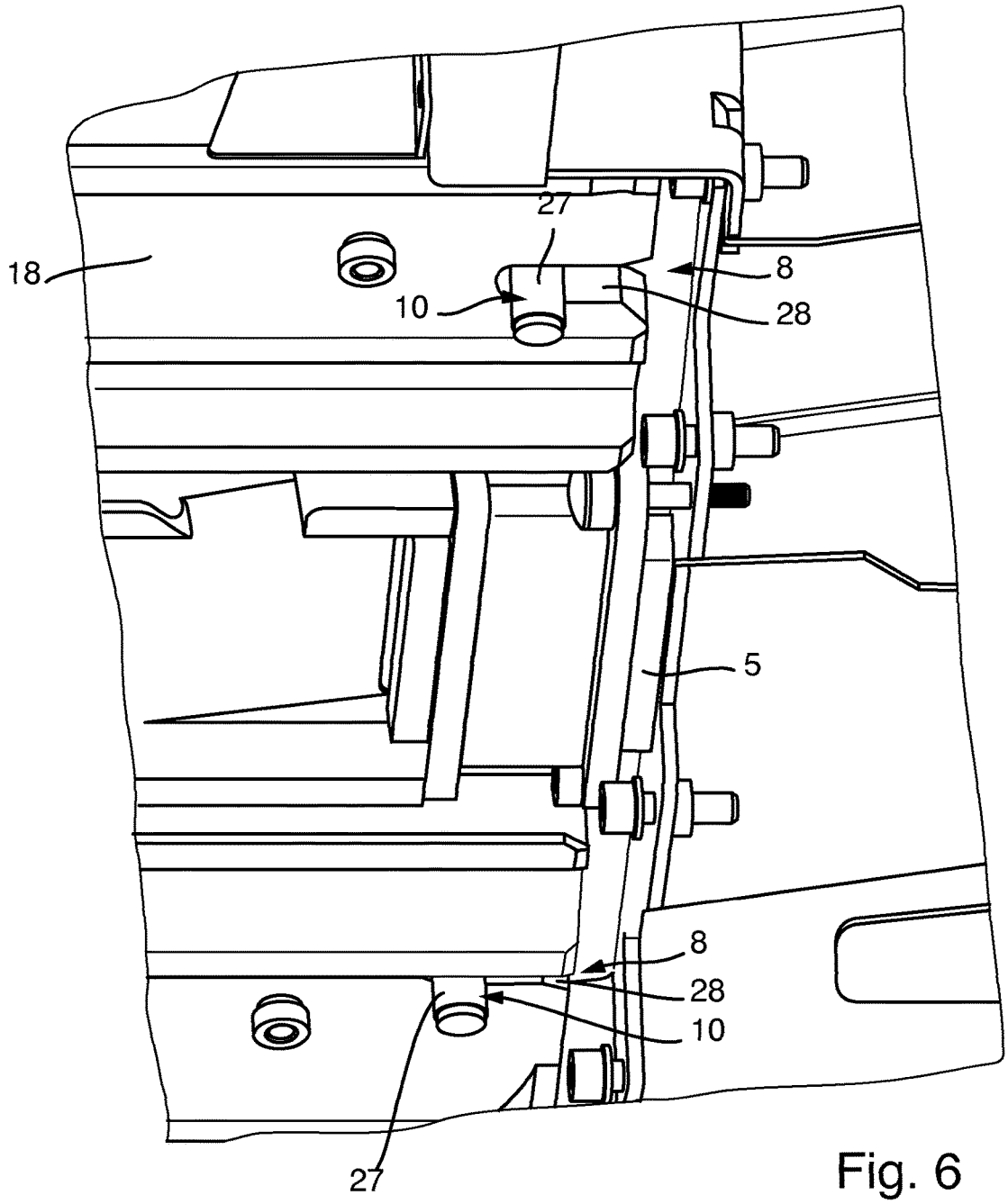
FIG. 6: A perspective view of the horizontal positioning aids in the form of vertical coupling pins and coupling recesses in the form of elongated holes open towards one side, whereby the horizontal positioning aids are being shown in the engaged position, viewed from the underside of the connection.

The horizontal positioning aids 8 which are separate and spaced from vertical positioning aids 7, as shown on FIG. 4 and FIG. 6, comprise engaging coupling parts 10, one of which can be designed as coupling edge and another as coupling recess. In particular, an upwardly extending coupling pin 27 can be provided, which can be inserted into an elongated hole 28 open on the front side which extends with its longitudinal axis parallel to the coupling and uncoupling axis 24. Said elongated hole 28 can, in this case, have an inlet bevel on the open mouth which centers the coupling pin with the longitudinal axis of the elongated hole 28 when inserting it.

Said coupling pins 27 can in this case form coupling part 10*a* of the device terminal 2 and be rigidly attached to its connection section 23, while the elongated hole 28 can form the coupling part 10*b* of the operator's seat 3 and can be located on its connection section 22. In general, however, a reverse arrangement would also be possible, i.e. the coupling pin 27 can also be provided on the operator's seat side, and the elongated hole 28 may be arranged on the device terminal side.

As shown on FIG. 6, it is also possible to provide several such coupling pins 27 and elongated holes 28 and thus several horizontal positioning aids 8, which can advantageously be arranged diagonally spaced symmetrical from a vertical longitudinal plane and particularly at the lateral edge sections of the connection sections 22 and 23.

According to the designs shown (see FIGS. 3 and 8), the coupling parts 9 are made in one piece, whereby two coupling flanges 25, which are symmetrically spaced from the electrical and signal coupling part 5*a* (cf. FIG. 8), protrude from a common base part 31. This can for example be designed as a simple sheet metal punching part.

As especially shown in FIG. 4, the coupling pin 27 is connected to the base part 31 in this example using a press fit on one end of the coupling pin 27. It may be mentioned that a different connection of the coupling pin 27 with the base part 31 is possible, for example by screwing, gluing, welding.

It should be noted that FIGS. 6 and 7 show a broken-away representation of the coupling, in particular the base part 31 is hidden so that the other components are more clearly visible.

To be able to lock and/or hold together operator's seat 3 with device terminal 2 in coupled position, clamping devices 14 (see FIG. 1 and FIG. 3) have been advantageously provided, with which the device terminal 2 and the operator's seat 3 can be braced against each other. Said clamping devices 14 can in this case have an upright main axis and be connected with the aforementioned vertical positioning aids 7, particularly their coupling flaps 25. As shown in FIGS. 4 and 5, the clamping devices 14 can include screw bolts 29 by means of which the connection section 22 of the operator's seat 3 can be screwed to the coupling flaps 25 (in end position). In this case a level top of the coupling flaps 25 is braced against the underside of the connection section 22 of the operator's seat 3. The clamping surfaces 15 which are drawn together in doing so, can in this case advantageously be designed flush.

FIGS. 4 and 5 show the vertical positioning aids 7 in a not yet fully engaged position, the screw bolt 29 is in this case only displayed for drawing technical reasons, i.e. while pushing operator's seat 3 and device terminal 2 together or pulling them apart, the screw bolt 29 is not present.

The invention claimed is:

1. A terminal system comprising a device terminal (2) as well as an operator's seat (3) which can be connected to the device terminal (2), wherein the device terminal (2) and the operator's seat (3) have electrical and/or signal coupling parts (5) and mechanical positioning coupling parts (6), which can be coupled, wherein the energy and/or signal coupling parts (5) and the positioning coupling parts (6) can be engaged with one another through pushing together the operator's seat (3) and device terminal (2) parallel to the ground, wherein the positioning coupling parts (6) have separately formed vertical and horizontal positioning aids (7; 8) in coupling direction for the vertical and horizontal alignment of the operator's seat (3) with the device terminal (2) when pushing together, characterized in that the vertical positioning aids (7) and the horizontal positioning aids (8) are separately designed coupling parts (9; 10), wherein the vertical positioning aids (7) have a clearance in horizontal direction diagonally to the coupling and uncoupling direction (24) and the horizontal positioning aids (8) have a clearance in vertical direction, wherein the vertical positioning aids (7) and/or the horizontal positioning aids (8) each comprise at least two pairs of mutually engageable coupling parts (9; 10), which are spaced from each other diagonal to a median longitudinal plane through the operator's seat (3) and/or through the device terminal (2), and wherein clamping devices (14) are intended for clamping the operator's seat (3) and device terminal (2) against each other, wherein said clamping devices (14) are assigned to the positioning coupling parts (6).

2. The terminal system according to claim 1, wherein said clamping devices (14) have a vertical direction of action.

3. The terminal system according to claim 1, wherein said clamping devices (14) are associated with the vertical positioning aids (7) and are intended for clamping the coupling parts (9) of the vertical positioning aids against each other.

4. The terminal system according to claim 1, wherein the vertical positioning aids (7) have overlapping, horizontally aligned clamping surfaces (15) which can be clamped against each other.

5. The terminal system according to claim 1, wherein the vertical positioning aids (7) and the horizontal positioning aids (8) are designed in such a way that the vertical positioning aids (7) are coupled at a different time than the horizontal positioning aids (8) and/or the vertical positioning aids (7) and the horizontal positioning aids (8) have differently sized overlaps in coupling direction (24), wherein the vertical positioning aids (7) are preferably coupled before the horizontal positioning aids (8).

6. The terminal system according to claim 1, wherein the coupling parts (9) forming the vertical positioning aids (7) comprise at least one pair of overlapping coupling edges (9*a*, 9*b*), wherein said coupling edges (9*a*, 9*b*) comprise, in particular, a flat tongue-shaped coupling flange (25) with a horizontally inclined run-on slope (30) as well as a level coupling surface which can be pushed over the coupling flange (25).

7. The terminal system according to claim 1, wherein the coupling parts (10) forming the horizontal positioning aids (8) comprise a coupling edge (10*a*) and a coupling recess (10*b*) receiving the coupling edge (10*a*), wherein said coupling edge (10*a*) is designed in particular as an upright stretching coupling pin and said coupling recess (10*b*) is designed in particular as a slot with an open front in coupling and uncoupling direction.

8. The terminal system according claim 1, wherein the connectable coupling parts (9; 10) are arranged in edge section areas of the connection sections (22, 23) of the operator's seat (3) and the device terminal (2).

9. The terminal system according to claim 1, wherein the vertical positioning aids (7) and the horizontal positioning aids (8) are arranged in a coupling area which is aligned to lay together.

10. A device terminal for a terminal system (1) designed according to claim 1, with at least one electrical and/or signal coupling part (5*a*) and at least one positioning coupling part (6*a*), wherein the at least one electrical and/or signal coupling part (5*a*) can be coupled with an electrical and/or a signal coupling part (5*b*) on the side of the operator's seat and said at least one positioning coupling part (6*a*) can be coupled with a positioning coupling part (6*b*) on the side of the operator's seat by pushing the device terminal (2) and operator's seat (3) together parallel to the ground, wherein the positioning coupling part (6*a*) has vertical and horizontal positioning aids (7,8) for the vertical and horizontal alignment of the device terminal (2) with the operator's seat (3), characterized in that the vertical positioning aids (7) and the horizontal positioning aids (8) are separately designed coupling parts (9;10), wherein the vertical positioning aids (7) have a clearance in horizontal direction diagonally to the coupling and uncoupling direction and the horizontal positioning aids (8) have a clearance in vertical direction, wherein the vertical positioning aids (7) and/or horizontal positioning aids (8) each comprise at least two pairs of mutually engageable coupling parts (9; 10), which are spaced from each other diagonal to a median longitudinal plane through the operator's seat (3) and/or through the device terminal (2) and wherein clamping devices (14) are intended for clamping the operator's seat (3) and device terminal (2) against each other, wherein said clamping devices (14) are assigned to the positioning coupling parts (6).

11. An operator's seats for a terminal system (1) designed according to claim 1, with at least one electrical and/or signal coupling part (5*b*) and at least one positioning coupling part (6*b*), wherein the at least one electrical and/or signal coupling part (5*b*) can be couple with a device-terminal-side electrical and/or signal coupling part (5*a*) and said at least one positioning coupling part (6*b*) can be coupled with a device-terminal-side positioning coupling part (6*a*) by pushing the operator's seat (3) together with the device terminal (2) parallel to the ground, wherein said at least one positioning coupling part (6*b*) has vertical and horizontal positioning aids (7,8) for the vertical and horizontal alignment of the operator's seat (3) with the device terminal (2), characterized in that the vertical positioning aids (7) and the horizontal positioning aids (8) are separately designed coupling parts (9,10), wherein the vertical positioning aids (7) have a clearance in horizontal direction diagonally to the coupling and uncoupling direction and the horizontal positioning aids (8) have a clearance in vertical direction, wherein the vertical positioning aids (7) and/or the horizontal positioning aids (8) each comprise at least two pairs of mutually engageable coupling parts (9; 10), which are spaced from each other diagonal to a median longitudinal plane through the operator's seat (3) and/or through the device terminal (2) and wherein clamping devices (14) are intended for clamping the operator's seat (3) and device terminal (2) against each other, wherein said clamping devices (14) are assigned to the positioning coupling parts (6).

* * * * *